US006184854B1

(12) United States Patent
Hotto et al.

(10) Patent No.: US 6,184,854 B1
(45) Date of Patent: Feb. 6, 2001

(54) WEIGHTED FRAME RATE CONTROL WITH DYNAMICALLY VARIABLE DRIVER BIAS VOLTAGE FOR PRODUCING HIGH QUALITY GRAYSCALE SHADING ON MATRIX DISPLAYS

(75) Inventors: Robert Hotto, 3109 Evening Way, Unit C, La Jolla, CA (US) 92037; Alan D. Wettig, San Diego, CA (US)

(73) Assignee: Robert Hotto, La Jolla, CA (US)

( * ) Notice: Under 35 U.S.C. 154(b), the term of this patent shall be extended for 0 days.

(21) Appl. No.: 08/500,371

(22) Filed: Jul. 10, 1995

(51) Int. Cl.[7] ..... G09G 3/36
(52) U.S. Cl. ..... 345/89; 345/147
(58) Field of Search ..... 345/89, 147–149

(56) References Cited

U.S. PATENT DOCUMENTS

| | | | | |
|---|---|---|---|---|
| 4,158,564 | * | 6/1979 | Garginer et al. | 96/1 R |
| 4,743,096 | * | 5/1988 | Wakai et al. | 345/89 |
| 4,962,433 | * | 10/1990 | Matsushima | 358/335 |
| 5,089,810 | * | 2/1992 | Shapiro et al. | 340/701 |
| 5,119,086 | * | 6/1992 | Nishioka et al. | 345/150 |
| 5,196,738 | * | 3/1993 | Takahara et al. | 345/89 |
| 5,196,839 | * | 3/1993 | Johary et al. | 345/148 |
| 5,220,315 | | 6/1993 | Clerc | 340/784 |
| 5,245,326 | * | 9/1993 | Zalph | 345/89 |
| 5,280,280 | | 1/1994 | Hotto | 345/94 |
| 5,293,159 | | 3/1994 | Bassetti, Jr. et al. | 345/149 |
| 5,302,946 | * | 4/1994 | Shapiro et al. | 345/88 |
| 5,347,294 | * | 9/1994 | Usui et al. | 345/89 |
| 5,428,739 | * | 6/1995 | Maeda | 345/147 |
| 5,465,102 | * | 11/1995 | Usui et al. | 345/89 |
| 5,489,918 | * | 2/1996 | Mosier | 345/89 |
| 5,532,718 | * | 7/1996 | Ishimaru | 345/89 |
| 5,539,432 | * | 7/1996 | Kobayashi | 345/147 |
| 5,555,460 | * | 9/1996 | Ericsson | 345/147 |
| 5,689,280 | * | 11/1997 | Asari et al. | 345/89 |
| 5,784,039 | * | 7/1998 | Yasui et al. | 345/89 |
| 5,815,128 | * | 9/1998 | Hoshino et al. | 345/89 |

OTHER PUBLICATIONS

Article: A Gray–Scale Drive Method for TFT–LCDs with Binary–Value–Output Drivers. Okada and others. SID 95 Digest, vol. P–4, pp. 396–399.

Article: MultiColor Display Control Method for TFT–LCD. Mano et al. SID 91 Digest, pp. 547–550.

Article: 16–Level Gray–Scale Driver Architecture and Full–Color Driving For TFT–LCD. Takahara and others. Society For Information Displays. Chpt–3071 pp. 115–118. Sep. 1991.

Article: An Electroluminescent Display Simulation System and its Application for Developing Grey Scale Driving Methods. Markku Åuberg. Acta Polytechnica Scandinavica, Electrical Engineering Series No. 74, 76 pp. Helsinki, Oct. 1993.

* cited by examiner

*Primary Examiner*—Amare Mengistu
(74) *Attorney, Agent, or Firm*—John L. Rogitz

(57) ABSTRACT

A system for improving the grayshading of matrix displays that effect grayshading by frame rate control (i.e., temporal dithering) includes a computer program which dynamically controls the bias voltage of the electrodes that define the pixels of the display. Per frame rate control principles, an image is established by a plurality of sequentially displayed frames, with the energization of the pixels of the frames being dithered so that the frames together establish a desired grayshading for the image. In accordance with the present invention, the electrode bias voltage to the display is dynamically varied for each frame and/or row to provide for an increased number of grayshades vis-a-vis frame rate control systems that have a constant bias voltage.

18 Claims, 2 Drawing Sheets

Figure 1
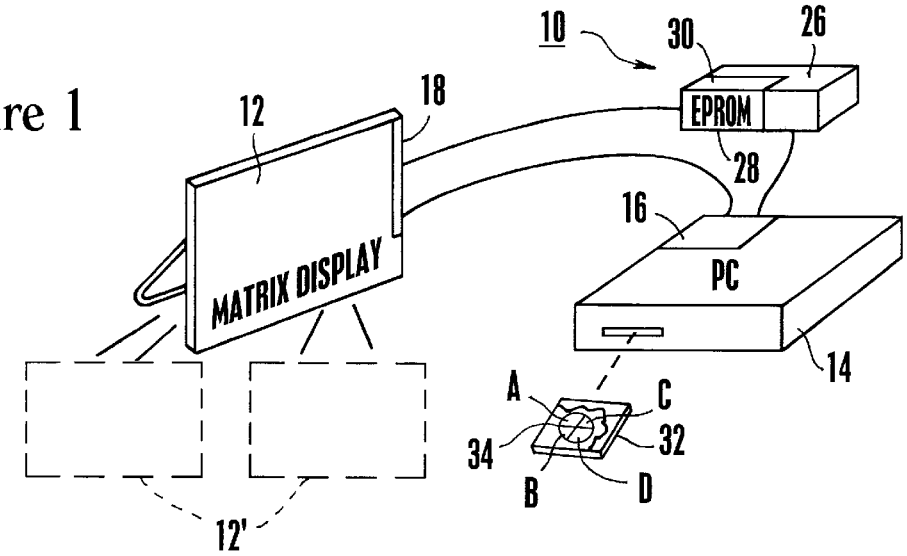
Figure 2
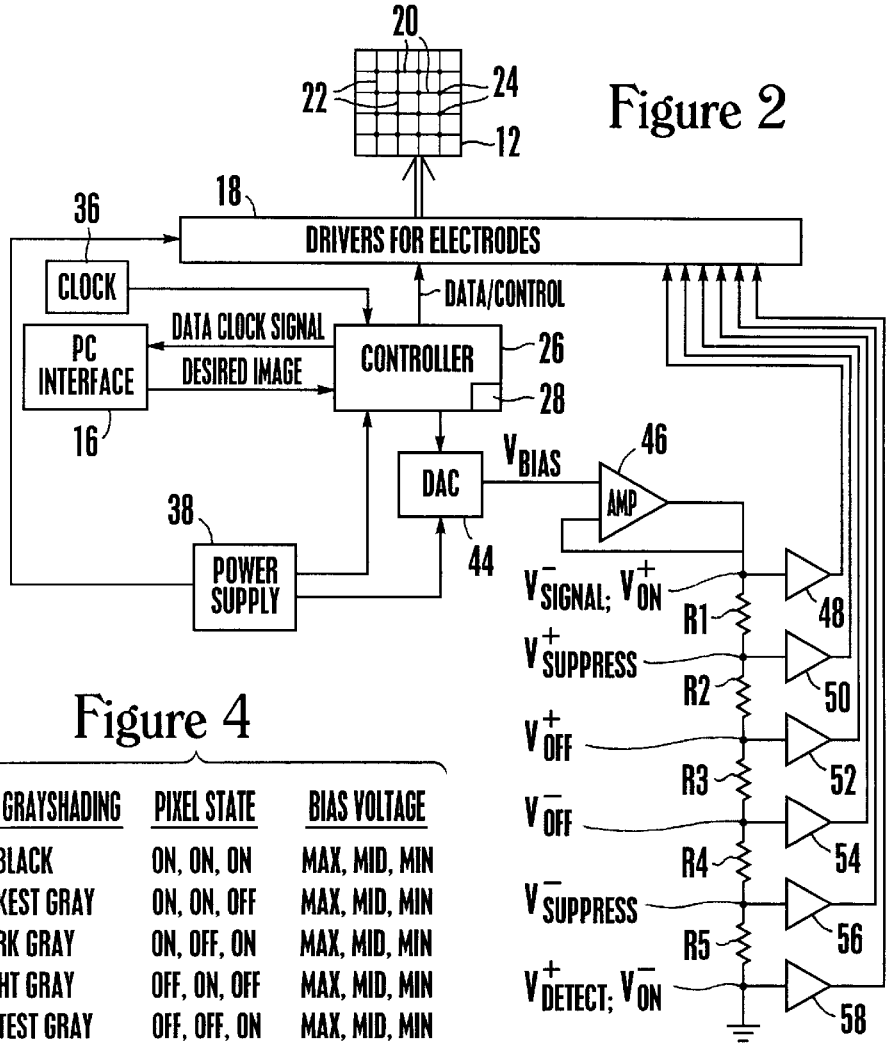
Figure 4
| DESIRED GRAYSHADING | PIXEL STATE | BIAS VOLTAGE |
|---|---|---|
| BLACK | ON, ON, ON | MAX, MID, MIN |
| DARKEST GRAY | ON, ON, OFF | MAX, MID, MIN |
| DARK GRAY | ON, OFF, ON | MAX, MID, MIN |
| LIGHT GRAY | OFF, ON, OFF | MAX, MID, MIN |
| LIGHTEST GRAY | OFF, OFF, ON | MAX, MID, MIN |

WEIGHTED FRAME RATE CONTROL WITH DYNAMICALLY VARIABLE DRIVER BIAS VOLTAGE FOR PRODUCING HIGH QUALITY GRAYSCALE SHADING ON MATRIX DISPLAYS

FIELD OF THE INVENTION

The present invention relates generally to grayscale control of matrix displays, and more particularly to frame rate modulation of matrix displays to achieve high quality grayscale control.

BACKGROUND

Matrix displays for displaying visual images include active and passive matrix liquid crystal displays (LCDs), light emitting diode (LED) displays, electro-luminescent (EL) displays, and field emission displays (FEDS). Essentially, a matrix display is established by a grid consisting of co-parallel column electrodes that are perpendicularly juxtaposed with co-parallel row electrodes, with the intersections of the electrodes defining pixels. The intensity of each pixel is established by appropriately establishing the voltage difference between the corresponding electrodes that define the pixel. When properly arranged by means of controlling the voltages imposed on the pixels, the combination of lighted and unlighted pixels establishes the image sought to be presented.

Most matrix displays use what is essentially multiplexing in establishing the voltage (and, hence, intensity) for each pixel. More specifically, a single frame of a matrix display (which can represent a single still image) ordinarily is established by sequentially enabling the rows of pixels, i.e., illuminating the rows of pixels one at a time starting at the top row and working down row by row to the bottom row.

To enable a row, the row is energized with a "select" voltage which enables each pixel in the row to be excited when a relatively high "on" voltage is applied to its corresponding column electrode. A pixel will remain substantially unexcited, however, when a relatively low "off" voltage is applied to its corresponding column electrode. In contrast, the non-enabled rows are energized with a "suppress" voltage, which prevents the pixels in the rows from being excited regardless of the voltage of the column electrodes. Accordingly, with this scheme the voltages of the column electrodes are established as appropriate for generating the portion of the desired image which is to be produced by whichever row is enabled.

Preferably, to avoid visual artifacts and particularly to avoid flickering in video/animation (i.e., moving) presentations, the individual still images that define the video presentation are displayed and regenerated quickly, typically in 1/30 of a second. By updating matrix displays, i.e., by regenerating the still images that together establish a video presentation, at thirty Hertz (30 Hz), a video display consisting of successively presented still images can be presented. Accordingly, it will readily be appreciated that the larger the matrix display (many displays have 480 rows and 640 columns or more) and the faster the frames are to be regenerated, the shorter the time available to excite, i.e., to drive, each pixel.

With short drive periods, control of the display is made more difficult. It happens, however, that display control is important in causing the display to present not just pure black and white images (corresponding to pixels being either on or off), but to also display various shades of gray, termed herein "grayshading". Effective grayshading results in better, more realistic-appearing images.

Not surprisingly, past efforts have been made to provide for grayshading of matrix displays. Generally, these past efforts have either required spatial dithering or temporal dithering, also referred to as frame rate control.

In spatial dithering, perceptions of various levels of gray are achieved by grouping pixels and illuminating the individual pixels in a group as required to achieve an overall gray shade for the group. In other words, spatial dithering recognizes that the human eye will integrate the blackness of various pixels in a small group of pixels with the whiteness of various other pixels in the group to perceive the desired shade of gray. Unfortunately, one drawback of spatial dithering is that display resolution is reduced, because the smallest individual unit of display effectively is no longer a single pixel, but a single group of pixels.

In contrast to spatial dithering, which averages the simultaneous appearance of a group of pixels, frame rate control averages the appearance of individual pixels over time. Thus, in a simple example, a single image might be established by two frames instead of one, making possible three shades for each pixel of the image. More specifically, in this simple example a pixel could be perceived as white, if the pixel is white for both frames, or black, if the pixel is black for both frames, or gray, if the pixel is white for one frame and black for the other frame. Because the eye integrates the appearance of the pixel, under current frame rate control it makes no difference whether a gray pixel is black or white during the first frame, as long as it assumes the opposite shade during the second frame.

Thus, frame rate control systems using "n" frames per image must generate the frames at "n" times the desired image regeneration frequency. Unfortunately, it happens that in many types of matrix displays, e.g., LCDs, the pixels cannot instantly be turned from "on" to "off", and require a finite relaxation time to essentially deenergize, making extremely rapid update rates difficult to achieve and control. Compounding this problem is the multiplexing characteristic of matrix displays discussed above, wherein the duty cycle of a pixel (i.e., the time available to energize the pixel) is a small fraction of the total number of rows. Accordingly, either the number of frames per image must be limited, thereby limiting the possible number of levels of grayshading, or the image regeneration rate must be slowed, thereby leading to display artifacts such as flicker, particularly when the presented image is changing.

As a variation of frame rate control, previous methods have modulated either the pulse height or pulse width of the voltage applied to the column electrodes, thereby modulating the overall intensity of the pixel (and, hence, establishing an apparent shade of gray). More specifically, with the enabled row electrode being energized with the "select" voltage, the column electrodes can be energized with various combinations of intensities or pulse widths of "on" voltages. While such methods can increase the possible number of grayshading levels, it remains difficult to precisely control grayshading by multiple pulsings of pixels, in light of large matrix sizes, rapid update rates, and the consequent low duty time of each pixel.

Accordingly, it is an object of the present invention to provide a system and method for establishing relatively many levels of grayshading in a matrix display, without unduly slowing the frame regeneration rate of the display. Another object of the present invention is to provide a system and method for establishing relatively many levels of grayshading in a matrix display which can relatively easily be backfit into existing displays. Yet another object of the present invention is to provide a system and method for establishing relatively many levels of grayshading in a matrix display which is controllable with comparatively high precision. Still another object of the present invention is to provide a system and method for establishing grayshading in a matrix display which is easy to use and cost-effective. Another object of the present invention is to provide a system and method for establishing grayshading in a matrix display which reduces artifacts in the presented image when the image is changing.

SUMMARY OF THE INVENTION

A system for establishing a desired grayshading of a desired image on a matrix display includes a matrix display that has a plurality of row and column electrodes. The system also includes a bias voltage establishing system for receiving a signal representative of the desired image and accessing a translation table to establish a bias voltage to the row and column electrodes in response thereto to cause the matrix display to present an image characterized by the desired grayshading.

Preferably, the bias voltage establishing system includes a digitally-controlled switch, more preferably a digital-to-analog converter (DAC), that is connected to the matrix display for selectively inputting to the matrix display a predetermined bias voltage. Stated differently, the DAC of the present invention is a bias voltage generator which generates and outputs one of a preselected number of bias voltages.

Additionally, the preferred system also includes a plurality of voltage drop elements that are connected to the matrix display for establishing select and suppress voltages. In accordance with the present invention, the bias voltage establishing system further includes a digital processing apparatus, and a computer program storage device that is readable by the digital processing apparatus. Also, the bias voltage establishing system includes a program means on the program storage device and including instructions executable by the digital processing apparatus for performing method steps for establishing a desired grayshading on the matrix display. These method steps include receiving the signal which is representative of the desired image, and causing the switch to dynamically establish the bias voltage in response thereto.

In another aspect of the present invention, a computer program storage device which is readable by a digital processing apparatus includes a program means including instructions executable by the digital processing apparatus for performing method steps for establishing a desired image grayshading on a matrix display characterized by a bias voltage. The programmable method steps include receiving a signal representative of the desired image grayshading from an image storage apparatus, and then dynamically establishing the bias voltage in response thereto.

In yet another aspect of the present invention, a computer program product is disclosed for use with a matrix display system having a plurality of row and column electrodes and a plurality of electrode drivers associated with the electrodes. Per the matrix display art, the matrix display system requires a bias voltage for presenting a sequence of images on the display, and each image is established by a plurality of frames. The computer program product includes a data storage device which in turn includes a computer usable medium that has computer readable means for establishing a grayshading for each frame. Thereby, a desired grayshading is established for each image. In accordance with the present invention, the computer readable means has computer readable code means for receiving a signal representative of the desired grayshading. Further, the computer readable means has computer readable code means for dynamically varying the bias voltage to the electrodes in response to the signal.

In still another aspect, a matrix display includes a plurality of row electrodes and column electrodes establishing the matrix and defining a plurality of pixels. A plurality of electrode drivers are associated with the electrodes to energize the pixels, and the electrode drivers receive a bias voltage. A bias voltage generator is connected to the electrode drivers for selectively inputting to the electrode drivers a predetermined bias voltage to cause the matrix display to present an image characterized by a desired grayshading.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a schematic view of the system for grayshading matrix displays of the present invention with plural display frames shown in phantom;

FIG. 2 is a block diagram of the present system; and

FIG. 4 schematically shows a translation table.

DETAILED DESCRIPTION OF THE PREFERRED EMBODIMENT

Figure 3:
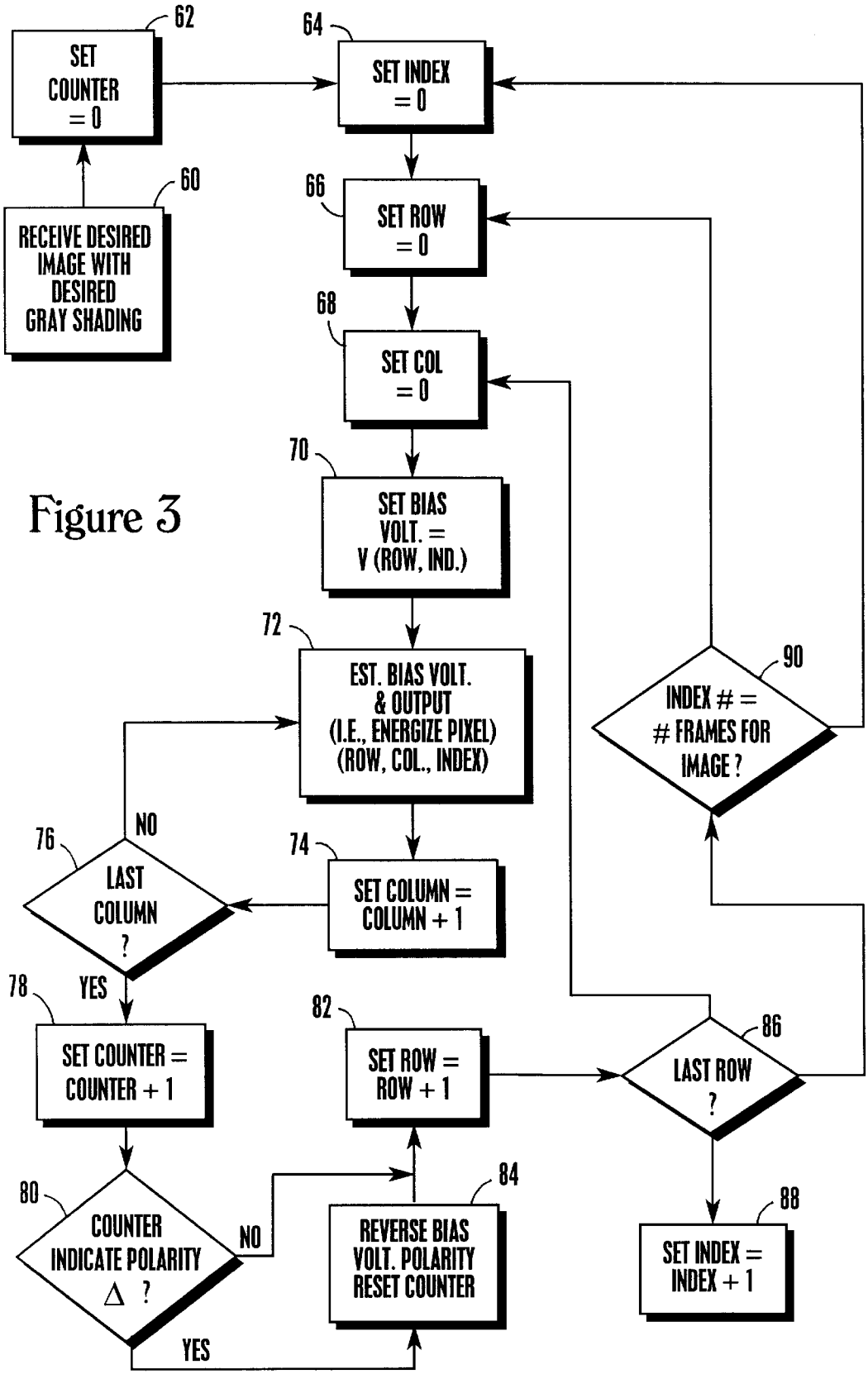
FIG. 3 is a flow chart of the logic of the present invention.

Referring initially to FIG. 1, a system is shown, generally designated 10, which is electrically connected to a single scan or dual scan matrix display 12 for programmatically dynamically controlling the bias voltage of the display 12 to establish a desired grayshading for an image presented on the display 12 as a series of frames 12'. It is to be understood that the matrix display 12 can be any matrix display known in the art, e.g., the matrix display 12 can be a liquid crystal display (LCD) made by Epson of Japan, or a light emitting diode (LED) display, or a electro-luminescent (EL) display, or a field emission display (FEDS).

A desired image to be presented on the matrix display 12 can be stored in an image storage apparatus, such as a personal computer (PC) 14 shown in FIG. 1, which is electrically connected to the system 10. In particular, a computer interface 16 interconnects the PC 14 with the system 10. While FIG. 1 shows for illustration purposes that the computer interface 16 is housed with the PC 14, it is to be understood that the computer interface 16 can be housed with the system 10. Regardless of its physical location, the computer interface 16 is any well-known device suitable for transmitting the images stored in the PC 14 to a matrix display.

In cross-reference to FIGS. 1 and 2, the matrix display 12 includes a plurality of electrode drivers 18. In accordance with principles well-known in the matrix display art, the electrode drivers 18 control the energization of row electrodes 20 and column electrodes 22, which together establish pixels 24 of the matrix display 12. Preferably, type SED17x3 drivers made by SMOS Systems of San Jose, Calif. are used to drive four hundred eighty (480) row electrodes 20, and type SED1766 drivers are used to drive six hundred forty (640) column electrodes 22.

FIGS. 1 and 2 show that the system 10 includes a digital processing apparatus, preferably a controller 26 including a program storage device 28 that is a computer readable medium. In the presently preferred embodiment, the controller 26 is a field programmable gate array chip made by Alterra of San Jose, Calif. In this embodiment, the program storage device 28 is electronic programmable read-only memory (EPROM).

As schematically shown in FIG. 1, the program storage device 28 includes a dynamic bias control module 30 which may be accessed by the controller 26 to dynamically establish the bias voltage of the matrix display 12. The dynamic bias control module 30 may reside, as stated above, in EPROM of the controller 26. In the preferred embodiment wherein the controller 26 is made by Alterra, the dynamic bias control module 30 is embodied in a hardwired circuit on the controller 26 which is configured using the AHDL language provided by Alterra.

FIG. 3 illustrates the structure of the dynamic bias control module of the present invention as embodied in computer program software. Those skilled in the art will appreciate that FIG. 3 illustrates the structures of computer program code elements that function according to this invention. Manifestly, the invention is practiced in its essential embodiment by a machine component that renders the computer program code elements in a form that instructs a digital processing apparatus (that is, a computer) to perform a sequence of function steps corresponding to those shown in the Figures. The machine component is shown in FIG. 1 as EPROM having code elements embedded therein.

Alternatively, the dynamic bias control module 30 may be contained on a computer diskette 32 shown in FIG. 1. When the module 30 is stored on the diskette 32, it can be schematically represented as a combination of program code elements A–D in computer readable form that are embodied in a computer-usable data medium 34, on the computer diskette 32. Or, the dynamic bias control module 30 may be stored on a DASD array, magnetic tape, conventional hard disk drive, electronic read-only memory, optical storage device, or other appropriate data storage device. In an illustrative embodiment of the invention, computer-executable instructions related to the dynamic bias control module 30 may be lines of compiled $C^{++}$ language code.

Referring now to FIG. 2, a computer clock 36 is connected to the controller 26 to establish a data clock signal in accordance with principles well-known in the art. As shown, this data clock signal is sent from the controller 26 to the computer interface 16. In contrast, FIG. 2 shows that the computer interface 16 sends, from the PC 14, a signal representative of a desired image to the controller 26. It is to be understood that per well-known principles, the signal representing the desired image represents, for each pixel, a desired grayshade, such that the pixels together, when grayshaded as desired, establish the desired image.

FIG. 2 further shows that a computer power supply 38 is electrically connected to the electrode drivers 18 and controller 26 to provide electrical power thereto. Also, the power supply 38 is electrically connected to a digital-to-analog converter (DAC) 44. per the present invention, the DAC 44 receives the output of the power supply 38 and selectively generates a bias voltage in response to the controller 26 to send its output to an amplification operational amplifier (opamp) 46. As more fully disclosed below, the DAC 44 is essentially a switch that is controlled by the controller 26 to selectively transmit a predetermined bias voltage, designated VBIAS in FIG. 2, to the opamp 46. Stated differently, the DAC 44 is a bias voltage generator which can generate, e.g., one of two hundred fifty six (256) voltages as determined by the controller 26.

Stated differently, the bias voltage generator of the present invention dynamically establishes a bias voltage to the row and column electrodes 20, 22 in response to the controller 26 to cause the matrix display 12 to present an image characterized by the desired grayshading. It is to be understood that as intended herein, the bias voltage $V_{BIAS}$ of the present invention is the overall bias voltage (after processing by the amplification opamp 46 ) which is required by the electrode drivers of most matrix displays, which bias voltage heretofore has been variable only by means of a hand-manipulated potentiometer, not to programmatically dynamically control grayshading, but merely to control the overall contrast of the display 12. Preferably, the DAC 44 is a digital-to-analog converter made by Maxim of Sunnyvale, Calif., and the amplification opamp 46 is a type LM324 opamp made by National Semiconductor of Santa Clara, Calif. Alternatively, the DAC 44 can be replaced by an analog switch with an associated variable resistor network (not shown) for dynamically establishing a bias voltage, or the DAC 44 can be replaced by a transistor (not shown).

As can be appreciated in reference to FIG. 2, the selected bias voltage $V_{BIAS}$ is amplified by the amplification opamp 46 and then sent, via a first voltage following stabilizer opamp 48, to each one of the electrode controllers 18 to establish both a negative field select voltage $V^-_{select}$ and a positive field pixel on voltage $V^+_{on}$. As the skilled artisan will recognize, most matrix displays use negative field scans that are referenced to a negative polarity in combination with positive field scans that are referenced to a positive polarity to prolong electrode life in accordance with well-known principles. As the skilled artisan will further recognize, the amplified bias voltage accordingly establishes the voltage that is applied via respective electrode drivers 18 to row electrodes 20 to multiplexively select one of them for pixel excitation during negative fields, and the voltage that is applied via respective electrode drivers 18 to selected column electrodes 22 to energize the column electrodes during positive fields.

In addition, the amplified bias voltage $V_{BIAS}$ is sent to a first voltage drop resistor R1, the output signal of which establishes a positive suppression voltage $V^+_{suppress}$ that is applied via a second stabilizer opamp 50 and respective electrode drivers 18 to non-selected row electrodes 20 during positive fields to prevent the non-selected electrodes from illuminating their associated pixels. Still further, the positive suppression voltage $V^+_{suppress}$ is sent to a second voltage drop resistor R2, the output signal of which establishes a positive off voltage $V^+_{off}$ that is applied via a third stabilizer opamp 52 and respective electrode drivers 18 to selected column electrodes 22 during positive fields to prevent energization of the column electrodes 22.

Moreover, the positive off voltage $V^+_{off}$ is sent to a variable voltage drop resistor R3, the output signal of which establishes a negative off voltage $V^-_{off}$ that is applied via a fourth stabilizer opamp 54 and respective electrode drivers 18 to selected column electrodes 22 during negative fields to prevent energization of the column electrodes 22. In turn, the negative off voltage $V^-_{off}$ is sent to a fourth voltage drop resistor R4, the output signal of which establishes a negative suppress voltage $V^-_{suppress}$ that is sent via a fifth stabilizer opamp 56 to non-selected row electrodes 20 during negative fields to prevent the non-selected electrodes from illuminating their associated pixels. And, the negative suppression voltage $V^-_{suppress}$ is sent to a fifth voltage drop resistor R5, the output signal of which establishes both a positive field select voltage $V^+_{select}$ and a negative field pixel on voltage $V^-_{on}$. This output signal is sent via a sixth stabilizer opamp 58 and respective electrode drivers 18 to row electrodes 20 to multiplexively select one of them for pixel excitation during positive fields, and to selected column electrodes 22 to energize the column electrodes during negative fields. If desired, the voltage drop resistors R1–R5 can be replaced by respective transistors or by respective DACs.

Now referring to FIG. 3, the logic of the dynamic bias control module 30 can be seen. Starting at block 60 for each desired still image to be presented on the display 12, a signal representative of the desired image with desired pixel 22 grayshading is received from the computer interface 16. At block 62, a counter is initialized at zero, and then at block 64, a variable index, corresponding to the frame number of the image to be displayed, is initialized at zero (i.e., the first frame of an image is number 0, the second frame is number 1, and so on).

Moving to blocks 66 and 68 in sequence, the module 30 respectively initializes a row variable to zero and a column variable to zero. From block 68, the module 30 proceeds to block 70 to generate a signal representative of the current row and current index (i.e., frame) number. Also, the signal generated at block 70 represents the desired gray shading for pixels in the current row.

The signal from block 70 is received at block 72. In understanding the operation of the module 30 at block 72, it is to be first understood that the present invention contemplates using a predetermined number of, e.g., three or four, frames to establish a single image. Accordingly, after receiving the desired grayshading for the pixels that are to establish the currently desired image, the module 30 determines, for each frame that is to constitute the desired image, what the pixel grayshading should be to arrive at the desired grayshading in combination with the other frames of the desired image.

For example, assume, for illustration purposes, that three frames are to establish a single image, and that the DAC 44 can selectively output only one of three bias voltages. If a "1" indicates pixel excitation (i.e., that the corresponding column electrode will be energized with an "on" voltage when the corresponding row electrode is selected), and a "0" indicates the pixel is not to be excited, the possible combinations for each pixel are as follows: <000>, <001>, <010>, <011>, <100>, <101>, <110>, <111>.

Because the bias voltage can be dynamically established for each frame independent of the bias voltages of the other two frames, <001>, <010>, and <100> are not equivalent, nor are <011>, <101>, and <110>, as they otherwise would be for previous systems in which the bias voltage is not programmatically dynamically variable. Stated differently, for the illustrated premise of three frames per image, only four different grayshades are possible without the dynamically variable bias voltage of the present invention; with it, at least eight are possible, resulting in more precise grayshade control with the same number of frames per image than would otherwise be available. As the skilled artisan will recognize, even more grayshades are possible, when additional bias voltages are generated, as they can be, by the bias voltage generator of the present invention.

Accordingly, at block 72 the module 30 accesses a translation table to translate the desired grayshading with a combination of pixel states and bias voltages. An example table is shown in FIG. 4 and is given below as Table 1 for illustration. It will readily be appreciated by those skilled in the art that the translation table shown can be modified as appropriate for the particular image storage apparatus and matrix display system to be used. Consequently, it can be further appreciated that the use of a translation table facilitates easily reconfiguring the table as appropriate for the particular display being used.

TABLE 1

| Desired Grayshading | Pixel State | Bias Voltage |
|---|---|---|
| black | ON, ON, ON | MAX, MID, MIN |
| darkest gray | ON, ON, OFF | MAX, MID, MIN |
| dark gray | ON, OFF, ON | MAX, MID, MIN |
| light gray | OFF, ON, OFF | MAX, MID, MIN |
| lightest gray | OFF, OFF, ON | MAX, MID, MIN |
| white | OFF, OFF, OFF | MAX, MID, MIN |

In addition, at block 72 the module 30 can dither the bias voltage row to row, to maintain an average intensity for the display. Thereby, the appearance of the image of fading in and out is minimized and, hence, display artifacts are reduced. More particularly, for a desired bias voltage for a first row of an image (assuming the three voltages in the table above), the module 30 can impose the bias voltage for the first row on the first row during the first frame and then impose the desired bias voltage of the first row onto the immediately following row during the second frame. Continuing with the novel spatial dithing disclosed herein, the bias voltage for the second row in the first frame would move to, i.e., be imposed on, the third row in the second frame, and so on, with the bias voltage of the third row in the first frame being imposed on the first row in the second frame. Table 2 below illustrates the novel dithing technique of the present invention.

TABLE 2

| ROW # | Frame 1 Voltage | Frame 2 Voltage | Frame 3 Voltage |
|---|---|---|---|
| 1 | HIGH | MED | LOW |
| 2 | MED | LOW | HIGH |
| 3 | LOW | HIGH | MED |
| 4 | HIGH | MED | LOW |
| . | | | |
| . | | | |
| . | | | |
| 480 | LOW | HIGH | MED |

After determining the appropriate bias voltage, the module 30 outputs the data to the appropriate row and column electrodes 20, 22 for the particular index, i.e., frame number. Next, at block 74 the column variable is incremented upwardly by one, and then the module 30 proceeds to decision block 76 to determine whether the column is the last column of the display 12.

If the test at decision block 76 is false, the module 30 loops back to block 72. Otherwise, the module 30 proceeds to block 78 to increment the counter upwardly by one, and then determines, at decision block 80, whether the counter indicates that a polarity change in the electrode voltages should be undertaken in accordance with principles well-known in the art to prolong electrode life.

If the module 30 determines, at decision block 80, that a polarity change is not indicated, the module 30 proceeds to block 82 to increment the row upwardly by one. On the other hand, if, at decision block 80, the module 30 determines that a polarity change is indicated, the module 30 proceeds to block 84 to reverse the polarity of the bias voltage (and, hence, the select, suppress, on, and off voltages that are sent to the electrodes 20, 22), and to reset the counter to zero. From block 84, the module 30 proceeds to block 82.

From block 82, the module 30 moves to decision block 86, wherein the module 30 determines whether the row being considered is the last row of the display 12. If it isn't, the module 30 loops back to block 68. Otherwise, the module 30 increments the index upwardly by one at block 88, and then determines, at decision block 90, whether the index value indicates that the last frame of the image has been generated. If so, the module 30 loops back to block 64, but otherwise returns to block 66. Thus, those skilled in the art will recognize that the module 30 embodied in the controller 26 can dynamically establish the bias voltage value to the display 12 for each row of each frame, independent of the bias voltage value of the other rows and frames.

While the particular WEIGHTED FRAME RATE CONTROL WITH DYNAMICALLY VARIABLE DRIVER BIAS VOLTAGE FOR PRODUCING HIGH QUALITY GRAYSCALE SHADING ON MATRIX DISPLAYS as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A system for establishing a desired grayshading of a desired image on a matrix display, comprising:

a matrix display including a plurality of row and column electrodes and a voltage network; and a bias voltage establishing system for receiving a signal representative of the desired grayshading and dynamically correlating the desired grayshading to a bias voltage for input thereof to the voltage network, the voltage network energizing at least one row electrode to cause the matrix display to present an image characterized by the desired grayshading.

2. The system of claim 1, wherein the bias voltage establishing system includes a digitally-controlled switch connected to the matrix display for selectively inputting to the matrix display a selected one of a plurality of predetermined bias voltages.

3. The system of claim 1, further comprising a digital-to-analog converter (DAC).

4. The system of claim 3, wherein the DAC generates one of a preselected number of bias voltages.

5. The system of claim 4, further comprising a plurality of voltage drop elements connected to the matrix display for establishing select and suppress voltages.

6. The system of claim 2, wherein the bias voltage establishing system further includes:

a bias control module for establishing the desired grayshading on the matrix display, the module comprising:

logic means for receiving the signal representative of the desired image from an image storage apparatus; and logic means for accessing a translation table to cause the switch to establish the bias voltage in response to the logic means for receiving.

7. A bias voltage control module for establishing a desired image having a desired grayshading on a passive matrix display, the display including row electrodes and column electrodes, a bias voltage being applied to the row electrodes and column electrodes, the control module comprising:

logic means for receiving a signal representative of the desired grayshading from an image storage apparatus;

logic means for generating a predetermined number of frames to establish the desired grayshading, the frames together establishing the desired image; and logic means for dynamically establishing the bias voltage for each frame based on the desired grayshading, only a single row electrode at a time being selected for energization.

8. The bias voltage control module of claim 7, further comprising logic means for accessing a translation table using the desired grayshading as entering argument and generating an output signal in response for controlling a switch to establish the bias voltage.

9. The bias voltage control module of claim 8, wherein the matrix display is characterized by row electrodes and column electrodes, with the row electrodes being sequentially designated one at a time as a select row, and the module further comprises logic means for selectively establishing the bias voltage for each row.

10. The bias voltage control module of claim 9, wherein the matrix display is characterized by row electrodes and column electrodes, and wherein the image storage apparatus defines a first desired bias voltage for a first row for a first image, and the bias voltage control module further comprises logic means for establishing the first desired bias voltage for the first row during a first frame of the first image and establishing the first desired bias voltage for a second row during a second frame of the first image, the second row immediately following the first row.

11. A bias voltage module for use with a matrix display system having a plurality of row and column electrodes and a plurality of electrode drivers associated with the row and column electrodes and requiring a bias voltage for presenting a sequence of images on the display, each image being established by a plurality of frames, comprising:

logic means for establishing a grayshading for each frame to establish a desired grayshading for each image;

logic means for receiving a signal representative of the desired grayshading; and logic means for dynamically varying the bias voltage used by at least some of the row and column electrodes in response to the signal, only a single row at a time being energized.

12. The bias voltage module of claim 11, further comprising logic means for controlling a switch to dynamically establish the bias voltage.

13. The bias voltage module of claim 12, further comprising logic means for accessing a translation table to selectively establish the bias voltage for each row electrode.

14. The bias voltage module of claim 13, further comprising logic means for selectively establishing the bias voltage for each frame.

15. The bias voltage module of claim 14, wherein the signal representative of the desired grayshading defines a first desired grayshading for a first row for a first image, and the module further comprises logic means for establishing the first desired grayshading for the first row during a first frame of the first image and establishing the first desired grayshading for a second row during a second frame of the first image, the second row immediately following the first row.

16. A passive matrix display, comprising:

a plurality of row electrodes and column electrodes establishing a passive matrix and defining a plurality of pixels;

a reference voltage network receiving a bias voltage;

a plurality of electrode drivers associated with the electrodes to energize the pixels, the electrode drivers receiving signals from the reference voltage network; and at least one bias voltage generator connected to the reference voltage network for selectively generating, for use by the electrode drivers and based on a desired grayshading, a selected one of at least two predetermined bias voltages to cause the matrix display to present an image characterized by a desired grayshading.

17. The matrix display of claim 16, further comprising:

an image storage apparatus for storing a desired image characterized by the desired grayshading and for generating a signal representative thereof;

a bias voltage control module for establishing the desired grayshading on the matrix, the module comprising:

logic means for receiving the signal from the image storage apparatus; and logic means for causing the bias voltage generator to dynamically establish a bias voltage for use by at least some of the electrode drivers in response to the desired grayshading.

18. The matrix display of claim 17, wherein the image storage apparatus defines a first desired grayshading for a first row for a first image, and the module comprises logic means for establishing the first desired grayshading for the first row during a first frame of the first image and for establishing the first desired grayshading for a second row during a second frame of the first image, the second row immediately following the first row.

* * * * *